United States Patent [19]

Koike

[11] Patent Number: 4,865,568

[45] Date of Patent: Sep. 12, 1989

[54] TRIM ANGLE SENSOR FOR MARINE PROPULSION DEVICE

[75] Inventor: Takashi Koike, Hamamatsu, Japan

[73] Assignee: Sanshin Kogyo Kabushiki Kaisha, Shizuoka, Japan

[21] Appl. No.: 875,286

[22] Filed: Jun. 17, 1986

[30] Foreign Application Priority Data

Jun. 18, 1985 [JP] Japan ..... 60-130834
Feb. 5, 1986 [JP] Japan ..... 61-36148

[51] Int. Cl.[4] ..... B63H 21/26
[52] U.S. Cl. ..... 440/2; 440/53; 324/207; 324/208
[58] Field of Search ..... 440/2, 58, 60; 114/154, 114/158, 159, 53; 324/207, 208; 340/987

[56] References Cited

U.S. PATENT DOCUMENTS

| | | | |
|---|---|---|---|
| 89,015 | 4/1869 | Boon | 114/159 |
| 1,815,575 | 7/1931 | Mills | 340/987 |
| 3,722,456 | 3/1973 | Lambrecht et al. | 440/2 |
| 3,844,247 | 10/1974 | Collis et al. | 440/2 |
| 4,480,248 | 10/1984 | Sudo et al. | 324/207 |
| 4,492,922 | 1/1985 | Ohkubo | 324/207 |
| 4,722,705 | 2/1988 | Rawlings | 440/2 |

FOREIGN PATENT DOCUMENTS

| | | | |
|---|---|---|---|
| 692241 | 6/1953 | United Kingdom | 340/987 |
| 1136700 | 12/1968 | United Kingdom | 324/208 |

*Primary Examiner*—Sherman D. Basinger
*Assistant Examiner*—Thomas J. Brahan
*Attorney, Agent, or Firm*—Ernest A. Beutler

[57] ABSTRACT

Several embodiments of trim angle sensors for marine outboard drives that embody a gear reduction unit so that the sensor will operate only over a linear portion of its operational range.

9 Claims, 6 Drawing Sheets

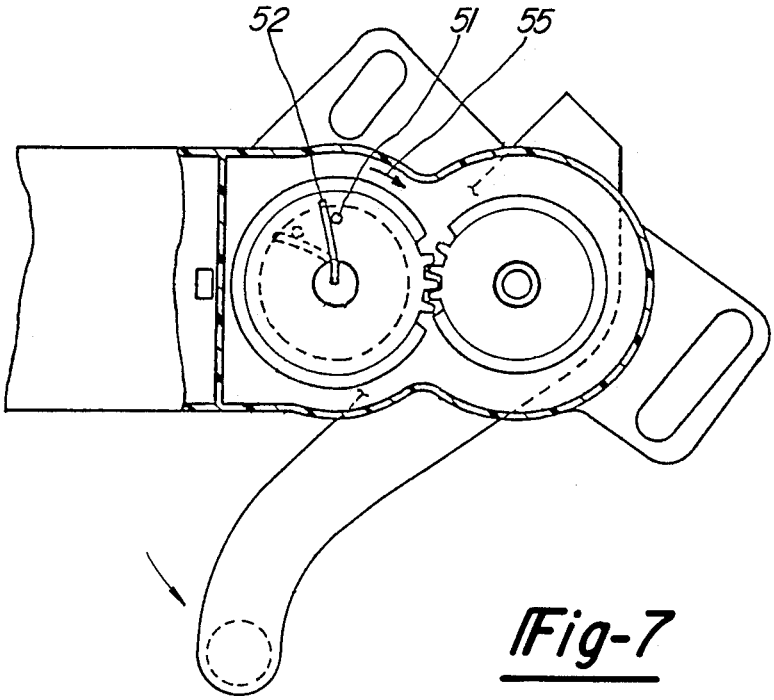
Fig-7
Fig-8
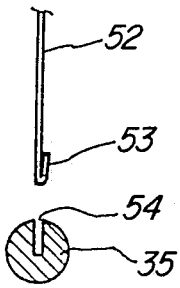
Fig-9
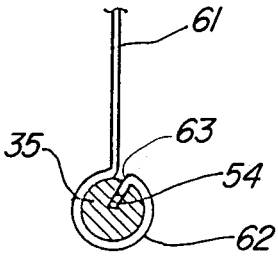

TRIM ANGLE SENSOR FOR MARINE PROPULSION DEVICE

BACKGROUND OF THE INVENTION

This invention relates to a trim angle sensor for a marine propulsion device and more particularly to an improved trim angle sensor that will provide a more accurate indication of the trim angle position through a wider range of movement than is possible with prior art type of devices.

In marine outboard drives (either an outboard motor or the outboard drive portion of an inboard/outboard drive), it is the common practice to suspend the outboard drive for pivotal movement about a horizontally extending tilt axis. This pivotal movement is employed for two purposes. First, it is employed so as to adjust the trim position of the outboard drive to the optimum angle for all running conditions; and second, it is employed so as to permit the outboard drive to be tilted up out of the water when not in use or for servicing.

In many instances, such mechanisms further include a trim angle sensor for providing a signal indicative of the adjusted trim angle of the outboard drive. This signal may be used either to provide an indication to a remotely positioned operator of the trim position or, alternatively, may be used in conjunction with such a remote indication and furthermore to function in a circuit for providing an automatically adjusted trim position. In such an application, the trim angle sensor provides a signal to the controlling circuit that indicates the actual trim angle of the outboard drive for processing through the circuit to change the trim angle, if necessary, to the optimum trim angle.

The type of trim angle sensors normally employed include, as a sensing element, some form of magnetically activated device such as a Hall effect sensor or a device in which a movable magnet actuates a sensor that has its resistance change in response to the change in magnetic force. Although such sensors are quite desirable, they are not accurate over a wide range of movement. By their very nature, magnetic sensors tend to have an output signal that varies similar to a sinusoidal wave. Thus, the accuracy of the sensor deteriorates under large degrees of movement resulting in either improper readings or the necessity for employing compensating circuits.

It is, therefore, a principal object of this invention to provide an improved trim angle sensor that is constructed in such a way that it will operate only over the linear phase of its motion.

It is a further object of this invention to provide a trim angle sensor employing a reduction system for insuring that large trim angle variations may be sensed in a linear manner by reducing the amount of movement of the sensor in relation to the actual amount of movement of the outboard drive.

It is a further object of this invention to provide an improved trim angle sensor embodying a gear reduction unit for this purpose.

When trim angle sensors are employed that utilize a reduction mechanism, such as a gear reduction, it is desirable to insure against backlash that could introduce incorrect readings into the system.

It is, therefore, a further objection of this invention to provide an improved trim angle sensor having a gear reduction unit and an arrangement for reducing backlash in the gear reduction unit.

SUMMARY OF THE INVENTION

This invention is adapted to be embodied in a sensor for sensing the angular relationship of an outboard drive member relative to a supporting member. An electrical sensor provides a signal in response to the relative positions of a fixed element and a movable element. Means are provided for fising the fixed element to one of the members and a contact element is adapted to engage the other of the members and is supported for movement upon relative pivotal movement of the members. A motion reduction means operatively couples the contact element to the movable element for effecting movement of the movable element relative to the fixed element upon relative pivotal movement of the members. The motion reduction means is effective to cause a lesser movement of the movable element than that of the contact element upon such relative pivotal movement.

BRIEF DESCRIPTION OF THE DRAWINGS

FIG. 7 is a side elevational view, in part similar to FIG. 4, on a larger scale, and shows another embodiment of the invention.

FIG. 8 shows an exploded view of the manner of installation of the lost motion take up in FIG. 7.

FIG. 9 is a cross-sectional view, in part similar to FIG. 8, showing another embodiment of the invention.

DETAILED DESCRIPTION OF THE PREFERRED EMBODIMENTS

Figure 1:
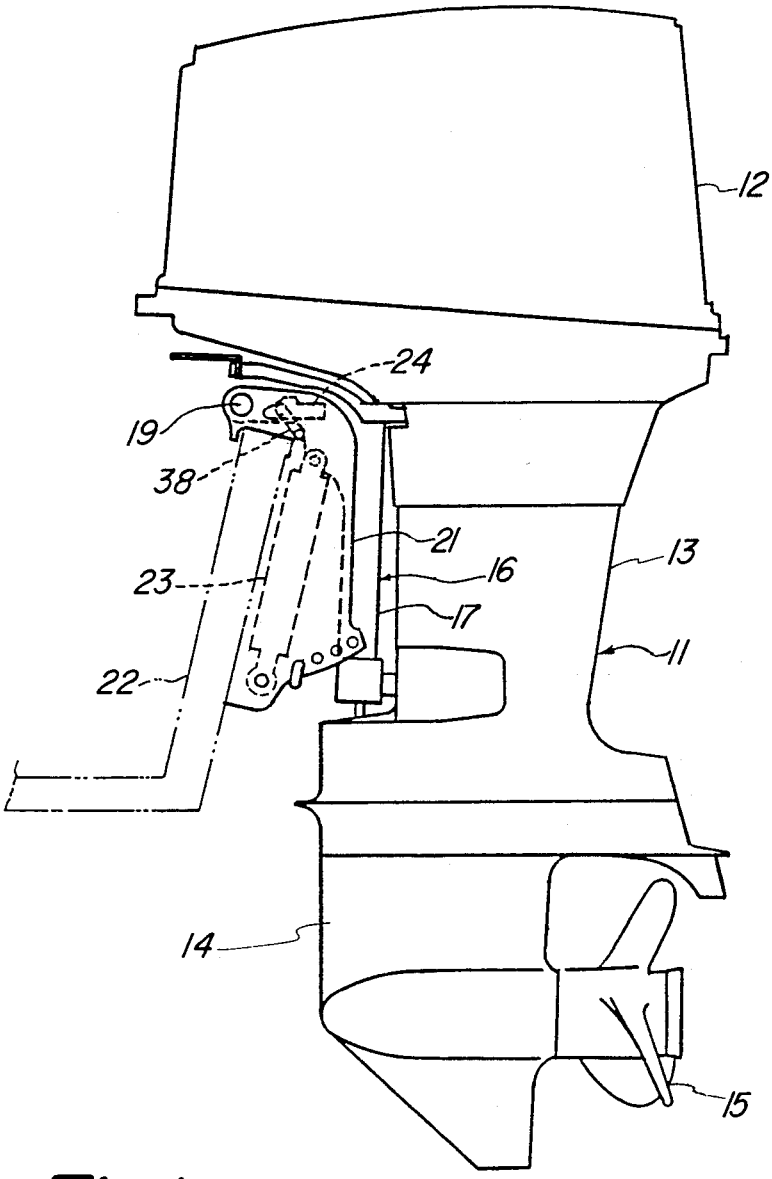
FIG. 1 is a side elevational view of an outboard motor having a trim angle sensor constructed in accordance with a first embodiment of the invention as shown attached to the transom of an associated watercraft, which watercraft is shown partially and in phantom.
Figure 2:
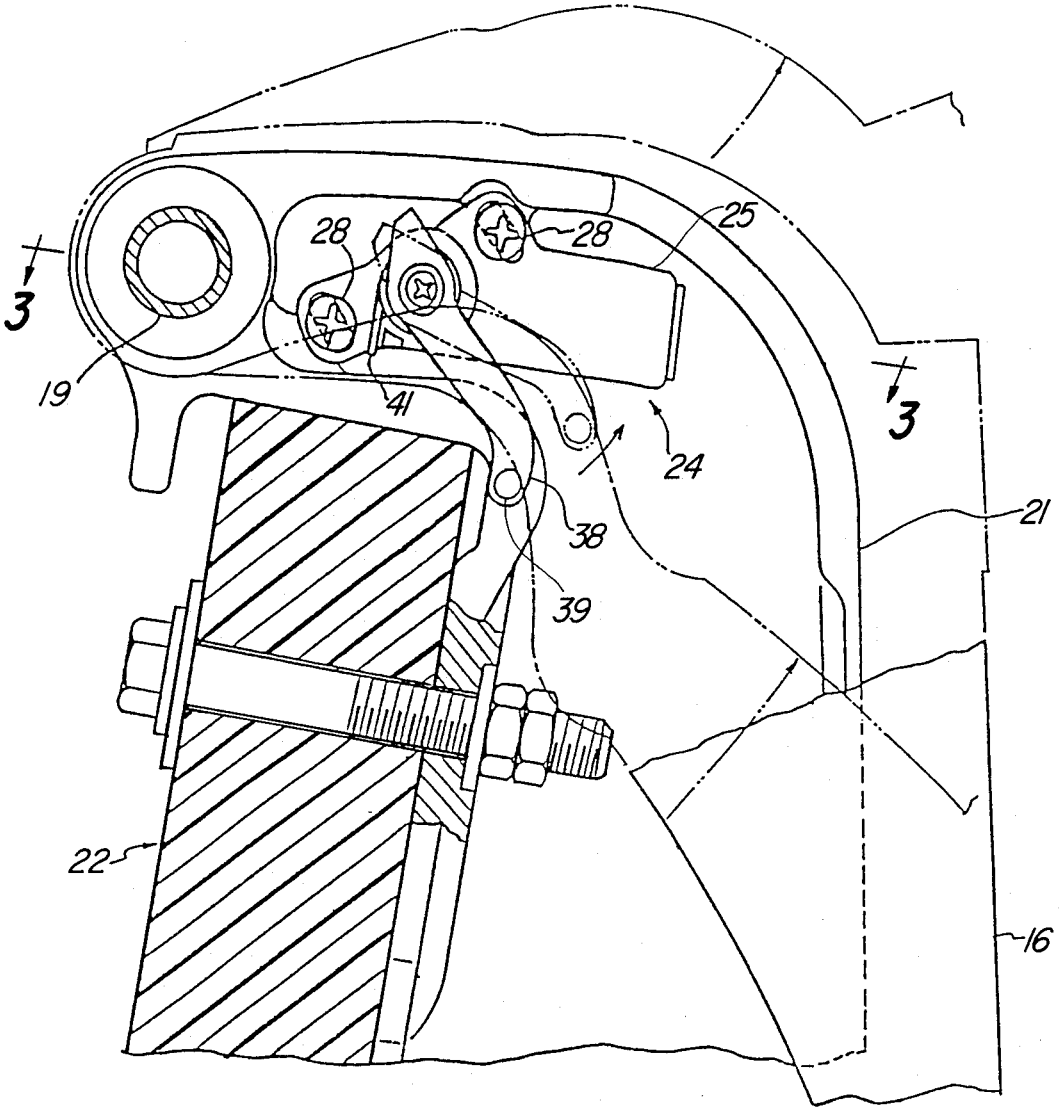
FIG. 2 is an enlarged side elevational view of the outboard motor, with portions away and other portions shown in phantom and illustrates the sensor in more detail.
Figure 3:
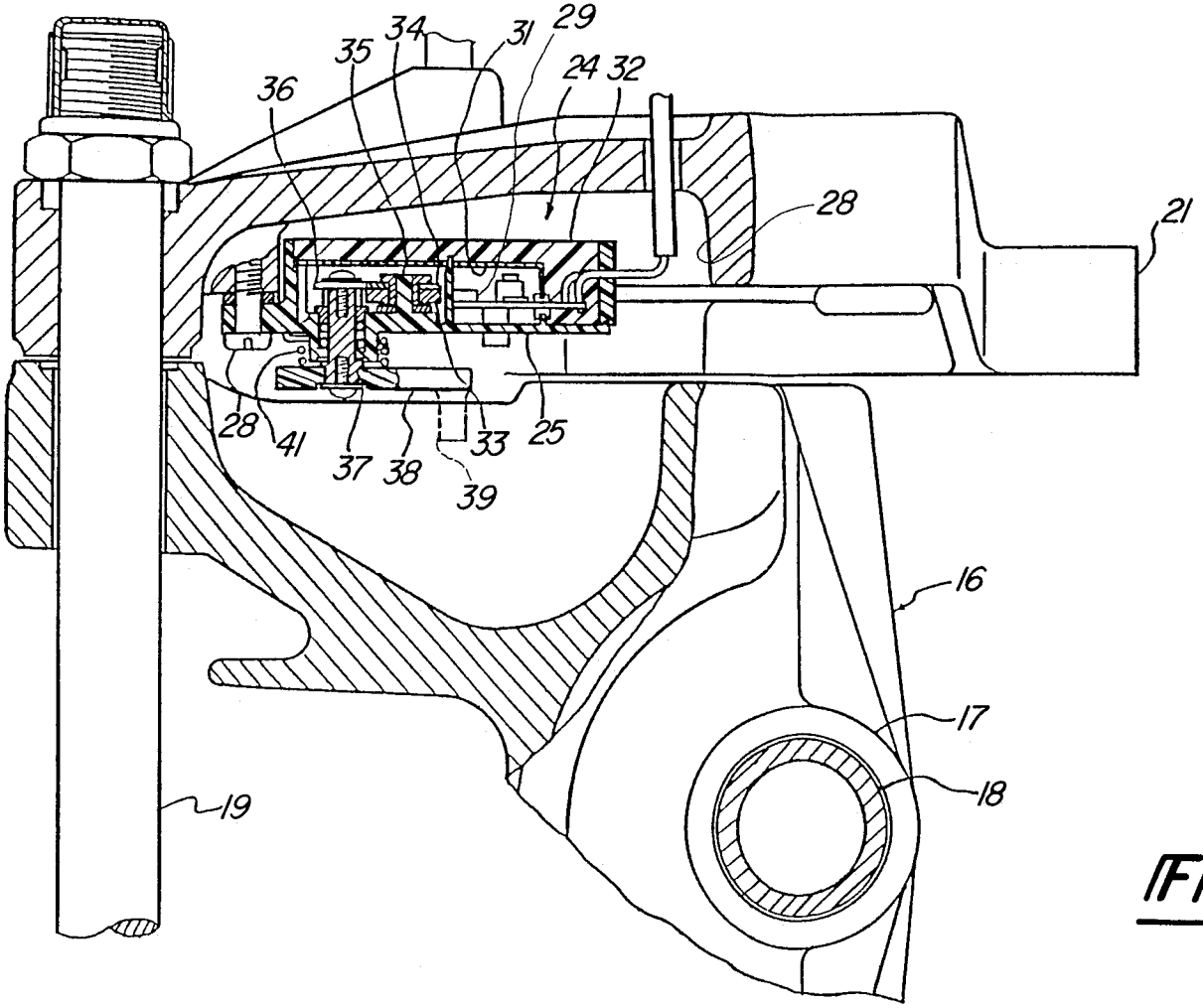
FIG. 3 is a cross-sectional view taken through the pivot axis of the outboard motor and through the sensor and generally along the line 3—3 of FIG. 2.
Figure 4:
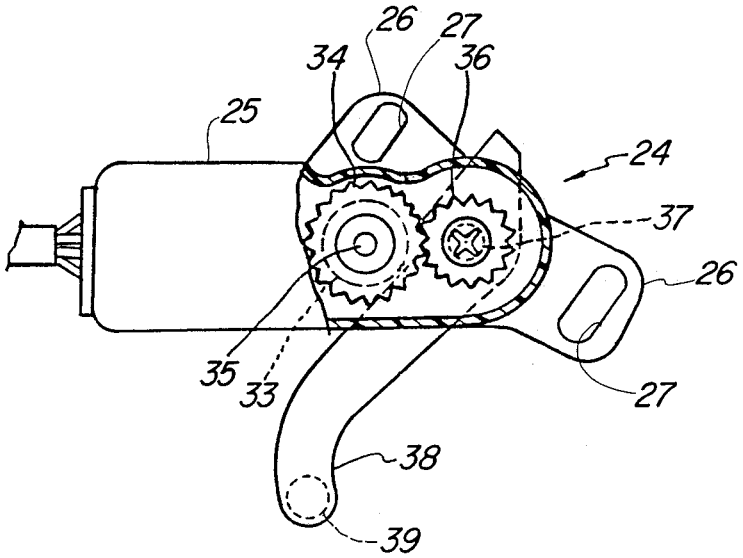
FIG. 4 is a side elevational view of the sensor, with a portion broken away, looking in the direction opposite to FIG. 2.

The invention is shown as applied to an outboard motor, indicated generally by the reference numeral 11. However, as has been noted, it is to be understood that the invention may be used equally as well in conjunction with the outboard drive portion of an inboard/outboard drive.

The outboard motor 11 includes a power head 12, drive shaft housing 13 and lower unit 14 that has a driven propeller 15. A swivel bracket 16 has a bearing portion 17 in which a steering shaft 18 is journaled. The steering shaft 18 is affixed, in a known manner, to the drive shaft housing 13 for steering of the outboard motor 11 about a generally vertically extending steering axis.

The swivel bracket 16 is, in turn, pivotally connected by means of a pivot pion 19 to a clamping bracket 21. The clamping bracket 21 is adapted to be affixed to the hull and specifically a transom 22 of an associated watercraft. A hydraulic motor of the linear type, indicated generally by the reference numeral 23, is interposed between the clamping bracket 21 and the swivel bracket 16 for effecting pivotal movement of the outboard motor 11 about the pivot pin 19 so as to adjust the trim and tilt angle of the outboard motor 11. The construction as thus far described may be considered to be conventional and, for that reason, it has not been illustrated in more detail and further description is not believed to be necessary to enable those skilled in the art to practice the invention.

A trim angle sensor constructed in accordance with an embodiment of the invention is identified generally by the reference numeral 24 and is operative between the clamping bracket 21 and swivel bracket 16 to provide a signal that is indicative of the angular position of the outboard motor 11 relative to the clamping bracket 21 and specifically its angular position about the pivot pin 19.

The trim angle sensing mechanism 24 includes a housing 25 that is formed with a pair of lugs 26 in which slots 27 are formed. The slots 27 pass screws 28 that are adapted to affix the sensor 24 within a recess 28 of one of the sides of the clamping bracket 21 in proximity to the pivot pin 19. Hence, the housing 25 will be fixed relative to the clamping bracket 21 and will not move relative to it.

Figure 5:
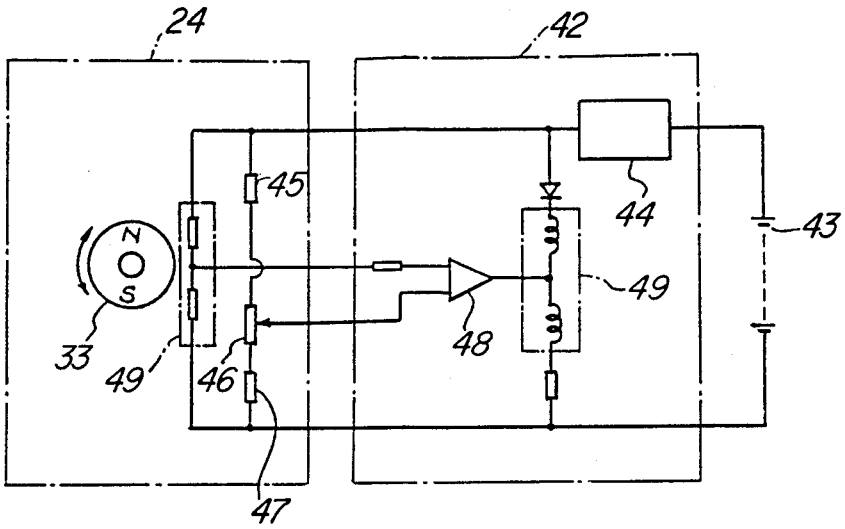
FIG. 5 is a schematic view showing how the sensor is wired into a related indicator circuit.

The sensor 25 includes a fixed sensing device 29 which is shown schematically in FIG. 5 and which is the type of device that has its resistance varied in response to a change in magnetic forces. Such a device is sold by Sony Corporation under the name SDME although it is to be understood that the invention may be employed in connection with various other types of position sensors and particularly those responsive to magnet signals.

The sensing device 29 is contained within a magnetic shield 31 carried within a potting compound 32 that is affixed appropriately to the housing 25 and which contians the sensing device 29.

A rotating ring magnet 33 is affixed to a gear 34 for rotation with this gear. The gear 34 is journaled on a post 35 formed by the housing 25. The gear 34, in turn, meshes with a gear 36 that is, in turn, affixed for rotation with a shaft 37. The shaft 37 is rotatably journaled within the housing 25 and extends outwardly from one side of it.

Affixed to the projecting end of the shaft 37 is a contact arm 38 having a lug 39 that is adapted to engage the swivel bracket 16. A torsional spring 41 encircles the shaft 37 and engages the contact arm 38 so as to hold its lug 39 in engagement with the swivel bracket 16.

In operation, the angular position of the swivel bracket 16 relative to the clamping bracket 21 will determine the position of the follower arm 38 with respect to the housing 25 and specifically to the fixed sensor 29. However, the angular movement of the arm 38 relative to the rotation of the magnet 33 is not in the same proportion due to the interposition the gears 36 and 34. These gears are sized so that the gear 36 is smaller in diameter than the gear 34 and hence a given angular movement of the arm 38 and shaft 37 will result in a smaller angular movement of the gear 34 and the magnet 33. The reason for this will become apparent.

Referring now to FIG. 5, a simple circuit diagram is illustrated that indicates how the sensor 24 may be utilized in conjunction with an indicator circuit, indicated generally by the reference numeral 42. The circuit includes a battery 43 that is in circuit through a constant voltage filtering circuit 44 with the sensor 29. In addition, there is provided a voltage divider circuit consisting of the resistors 45, 46 and 47 in parallel with the sensor 29. The output from the sensor 29 is delivered to one terminal of a differential amplifier 48. The other terminal of the differential amplifier 48 is in circuit with the resistor 46 and with a fixed coil 49 of an indicator device.

Figure 6:
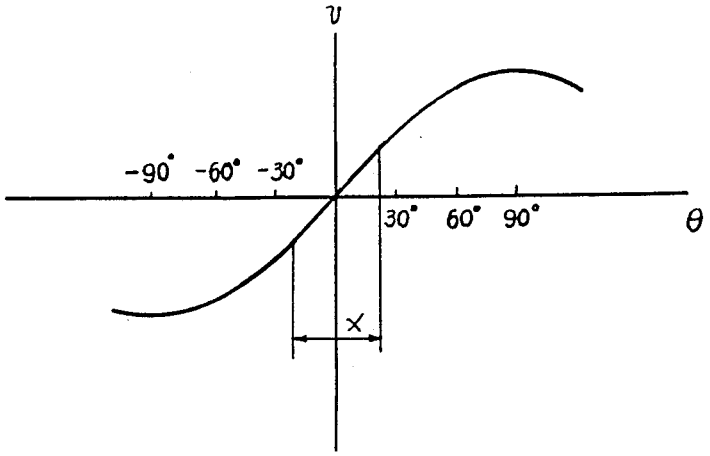
FIG. 6 is a schematic view showing the output relationship of the sensor.

FIG. 6 shows the relationship of the voltage drop across the device 29 in response to the angular position of the rotary magnet 33. As will be seen, the output voltage V varies with the angular relationship. $\theta$ similar to the shape of a sine curve. However, there is a linear portion that exists within approximately 55° centered at the null point. The purpose of the invention is to operate the device so that the sensor 29 operates within this linear range within the full trim angle adjustment of the outboard motor. Thus, the gear reduction unit consisting of the gears 36 and 34 serve to reduce the angular rotation of magnet 33 in response to a given angular movement of the arm 38 and swivel bracket 16 so as to confine the angular movement within this range. Thus, the device will operate in a completely linear manner even though the sensor 29 is itself not fully linear. That is, the device 29 is operated only in its linear range and, therefore, the sensor will provide a very good indication under all trim angle positions.

In the embodiment of the invention as thus far described, it is clear that the device operates in a very linear manner. However, the interposition of the gear train consisting of the gears 36 and 34 may introduce a very small amount of error into the system because of the backlash between the gears. FIGS. 7 and 8 show a further embodiment of the invention wherein an arrangement is incorporated for eliminating even this backlash condition. In these embodiments, the sensor construction and gear train generally are the same as the previously described embodiment and, for that reason, the components which are the same as the previously described embodiment have been identified by the same reference numerals and will be described again only insofar as is necessary to understand the construction and operation of this embodiment.

In this embodiment, a pin 51 is staked to one side of the geare 34. This pin 51 is engaged by an outwardly extending end of a leaf spring 52. The opposite end of the leaf spring 52 is folded back, as at 53, and is received in a slot 54 formed in the shaft 35. It should be noted that the shaft 35 does not rotate and hence the leaf spring 52 will apply a continuous force on the gear 34 in the direction of the arrow 55 so as to continuously take up the backlash between the gears 34 and 36. In this manner, even these small backlash induced errors will be eliminated.

FIG. 9 shows another embodiment of the invention and way in which the backlash may be eliminated. In this embodiment, a leaf spring 61 has an outwarding extending end which engages the pin 51 in the same manner as shown in FIG. 7. The opposite end of the spring 61 is formed with a coil 62 that encircles the shaft 35. A tang 63 formed at the end of the coil 62 is received in the slot 54 so as to non-rotatably affix this end of the leaf spring 61 to the shaft 35.

It should be readily apparent from the foregoing description that a number of embodiments of the invention have been illustrated and described, each of which is operative to provide an extremely reliable and linear type device for indicating the angular position of an outboard drive. Although several embodiments of the invention have been illustrated and described, various changes and modifications may be made without departing from the spirit and scope of the invention, as defined by the appended claims.

I claim:

1. A sensor for sensing the angular relationship of an outboard drive member relative to a supporting member comprising an electrical sensor for providing an output signal that varies sinusoidally in response to changes in the relative positions of a fixed element and a movable element, means for fixing said fixed element to one of said members, a contact element adapted to engage the other of said members and being supported for movement upon relative pivotal movement of said members, and a motion reduction means for operatively coupling said contact element to said movable element for effecting movement of said movable element relative to said fixed element upon relative pivotal movement of said members, said motion reduction means being effective to cause a lesser movement of said movable element than that of said contact element upon such relative pivotal movmenet for operating said electrical sensor in the linear portion of its range during the pivotal movement of said outboard drive.

2. A sensor as set forth in claim 1 wherein the motion reduction means comprises a gear unit.

3. A sensor as set forth in claim 2 further including means in said gear unit for eliminating backlash.

4. A sensor as set forth in claim 2 wherein the gear reduction unit comprises a first gear affixed for rotation with the movable element and a second gear affixed for rotation with the contact element, said first gear having a larger diameter than said second gear.

5. A sensor as set forth in claim 4 further including means in said gear unit for eliminating backlash.

6. A sensor as set forth in claim 1 wherein the electrical sensor comprises a magnetically responsive device.

7. A sensor as set forth in claim 6 wherein the movable element comprises a movable magnet.

8. A sensor as set forth in claim 7 wherein the gear reduction unit comprises a first gear affixed for rotation with the movable magnet and a second gear affixed for rotation with the contact element, said first gear having a larger diameter than said second gear.

9. A sensor as set forth in claim 8 further including means in said gear unit for eliminating backlash.

* * * * *